US008932013B2

(12) United States Patent
Khalitov et al.

(10) Patent No.: US 8,932,013 B2
(45) Date of Patent: Jan. 13, 2015

(54) GUIDE VANE AND INLINE FAN ASSEMBLY

(71) Applicant: Twin Fan Companies, Ltd., Minneapolis, MN (US)

(72) Inventors: Daniel Khalitov, St. Louis Park, MN (US); Michael J. Feuser, Fayetteville, TN (US)

(73) Assignee: Twin City Fan Companies, Ltd., Minneapolis, MN (US)

( * ) Notice: Subject to any disclaimer, the term of this patent is extended or adjusted under 35 U.S.C. 154(b) by 0 days.

(21) Appl. No.: 14/127,370

(22) PCT Filed: Oct. 5, 2012

(86) PCT No.: PCT/US2012/058881

§ 371 (c)(1),
(2) Date: Dec. 18, 2013

(87) PCT Pub. No.: WO2013/052752

PCT Pub. Date: Apr. 11, 2013

(65) Prior Publication Data

US 2014/0314559 A1 Oct. 23, 2014

Related U.S. Application Data

(60) Provisional application No. 61/543,512, filed on Oct. 5, 2011.

(51) Int. Cl.
*F04D 29/54* (2006.01)
*F04D 19/00* (2006.01)

(52) U.S. Cl.
CPC ..... *F04D 29/542* (2013.01); *F04D 19/005* (2013.01)
USPC ..... 415/211.2

(58) Field of Classification Search
CPC ..... F01D 5/141; F01D 5/142; F04D 29/542; F04D 29/444; F04D 19/07; F04D 19/002
USPC ..... 415/193, 195, 199.4, 211.2
See application file for complete search history.

(56) References Cited

U.S. PATENT DOCUMENTS

| | | | |
|---|---|---|---|
| 3,075,743 | A | 1/1963 | Sheets |
| 3,173,604 | A | 3/1965 | Sheets et al. |
| 4,512,718 | A | 4/1985 | Stargardter |
| 5,152,661 | A | 10/1992 | Sheets |
| 6,327,994 | B1 | 12/2001 | Labrador |
| 6,439,838 | B1 | 8/2002 | Crall et al. |
| 2002/0159883 | A1 | 10/2002 | Simon et al. |
| 2008/0073990 | A1 | 3/2008 | Chen |
| 2010/0209236 | A1 | 8/2010 | Freeman et al. |

FOREIGN PATENT DOCUMENTS

EP 0467336 A2 7/1991

OTHER PUBLICATIONS

Young, Lee W., PCT International Search Report and Written Opinion of the International Searching Authority, PCT Application No. PCT/US12/58881, Jan. 4, 2013.

Look, Edward, PCT International Preliminary Report on Patentability of the International Searching Authority, PCT Application No. PCT/US12/58881, Oct. 29, 2013.

*Primary Examiner* — Ninh H Nguyen
*Assistant Examiner* — Jeffrey A Brownson
(74) *Attorney, Agent, or Firm* — Nawrocki, Rooney & Sivertson, P.A.

(57) ABSTRACT

An improved guide vane for an inline fan is provided, as is an inline fan assembly so characterized. The vane guide includes a first vane segment characterized by first and second end portions, and a second vane segment characterized by first and second end portions. The second end portion of the first vane segment is in a spaced apart and overlapped arrangement in relation to the first end portion of the second vane segment. The first end portion of the first vane segment is an adjacent most vane guide end portion in relation to an impeller of the fan. The first vane segment is of arcuate configuration, with the second vane segment being of linear configuration.

17 Claims, 10 Drawing Sheets

GUIDE VANE AND INLINE FAN ASSEMBLY

This is an international application filed under 35 USC §363 claiming priority under 35 USC §120 of/to U.S. Pat. Appl. Ser. No. 61/543,512 filed Oct. 5, 2011 and entitled INLINE FAN ASSEMBLY/HOUSING WITH SLOTTED VANES, the disclosure of which is hereby incorporated by reference in its entirety.

TECHNICAL FIELD

The present invention generally relates to a guide vane for an inline fan, an inline fan housing and/or inline fan assembly characterized by guide vanes, more particularly, to guide vanes characterized by first and second spaced apart yet overlapping vane segments.

BACKGROUND OF THE INVENTION

The primary function of industrial fans is to provide a large fluid flow, with general utility in/for processes such as combustion, ventilation, aeration, particulate transport, exhaust, cooling, air-cleaning and drying. Fluid flow deliver is accomplished by rotating a number of blades, connected to a hub and shaft, and driven by a motor or turbine. Industrial fans are generally categorized as being either centrifugal or axial in nature, with each having a characteristic fluid flow path indicative of their monikers.

Centrifugal fans use a rotating impeller to increase the velocity of a fluid. As the fluid moves from the impeller hub to the fan blade tips, it gains kinetic energy, which in turn is converted to a static pressure increase as the air slows in advance of discharge.

Axial fans move fluid along the axis of the fan. The fluid is pressurized by the aerodynamic lift, i.e., axial forces, generated by the fan blades. Propeller, tubeaxial and vane axial fans are well know variants of this style fan, with the tubeaxial and vane axial being more complex versions of the propeller fan.

As is well known and documented, disruptions in connection to fluid flow fan ingress/egress can be particularly problematic, with at least one of either inlet or outlet flow conditioning proving advantageous, and, on occasion, both. For example, rotational energy can be translated into useful energy by a guide vane arrangement on an inlet, or more often times, on an outlet side of an axial fan. With such arrangement, a rotational velocity flow component is converted to an axial velocity component, with pressure correspondingly raised, and thus fan efficiency improved.

Guide vanes, in the form of airfoil structures, are known for conditioning unidirectional fan discharges (see e.g., U.S. Pat. No. 7,730,714 (Wood et al.) and U.S.Pub. U.S. 2012/0128494 (Pelley et al.)). Uniformly configured guide vanes in the form of single thickness elements are also known (see e.g., U.S. Pat. No. 5,246,339 (Bengtsson et al.) & U.S. Pat. No. 5,180,106 (Handfield)) as well as those part-and-parcel of a flow control device in the context of serial axial fans used in/for cooling electronic devices and the like (see e.g., U.S. Pat. No. 6,508,621 (Zeighami et al.), U.S. Pat. No. 7,942,627 (Jin), & U.S.Pub. U.S. 2008/0138201 (Lin et al.)). Moreover, non-uniformly configured guide vanes (FIG. 3E) and non-uniformly arranged (i.e., non-homogeneous) guide vanes (FIGS. 3C & D), provided in the form of a flow conditioning ring, are likewise known, at least in the context of lowering tonal components associated with fan operation (U.S. Pat. No. 5,470,200 (Tupov et al.)).

In a bidirectional context, axial fans are likewise known to include vanes for condition the flow passing through the impeller (see e.g., U.S. Pat. No. 4,219,325 (Gutzwiller) & U.S. Pat. No. 6,508,622 (Neumeier)). As to the former, in lieu of adjustable vanes and adjustable impeller blades, first and second sets of concavo-convex vanes, disposed adjacent each side of the impeller, are provided for in the context of a plug unit for a heat treating furnace (FIGS. 1 & 2), the arrangement generally being symmetrical (i.e., a 90° rotation of the FIG. 1 view provides an identical vane arrangement). As to the latter, a rotatable inlet stator 15 having a guide vane 17, and a rotatable outlet stator 16 having a guide vane 18 which is mirror-symmetrical to vane 17 (FIG. 2), the rotor disposed therebetween, is generally provided in the context of tunnel ventilation. Further contemplated are inlet and outlet vanes which are characterized by a fixed position section 22 and an adjustable section 23. Essentially, in reverse flow operation, the structures are adjusted such that the inlet stator 15 takes on the function of a downstream stator and downstream stator 16 takes on the function of an inlet stator.

While particularized fluid flow efficiency solutions are set forth with regard to inline fans, both in the context of unidirectional and bidirectional flow, solutions as to the latter are believed overly cumbersome. Notionally, competing interests or objectives are present with regard to inline fan systems, namely, there exists a design tension between aerodynamic load and structural load. While aiming to reduce, among other things, material quantities, the number of parts, and geometric complexity while nonetheless at least retaining, if not improving upon aerodynamic performance and mechanical stiffness, a less-is-more approach is believed advantageous. Provisions for an improved, low cost, low complexity guide vane which generally enhances fan/fan system performance with regard to fluid flow in a first or primary direction, yet nonetheless maintains at least a suitable fan/fan system performance in a second/secondary reverse flow is believed advantageous and heretofore unknown.

SUMMARY OF THE INVENTION

An improved guide vane for an inline fan is provided, as is an inline fan assembly so characterized. The vane guide includes a first vane segment characterized by first and second end portions, and a second vane segment characterized by first and second end portions. The second end portion of the first vane segment is in a spaced apart and overlapped arrangement in relation to the first end portion of the second vane segment. The first end portion of the first vane segment is an adjacent most vane guide end portion in relation to an impeller of the fan. The first vane segment is of arcuate configuration, with the second vane segment being of linear configuration.

Generally, and as should be appreciated with reference to the representative, non-limiting disclosure, guide vanes characterized by separate first and second portions or segments are provided, more particularly, slotted vanes having a "straight" segment and "curved" segment spaced apart therefrom yet overlapping so as to delimit a slot between opposing end portions of each of the segments are provided. Functionally, the subject two-part slotted guide vane keeps the airflow "attached" or "adhered" to the vane surface, while increasing the angle of swirl recovery, via, among other things, the spatial relationship between adjacent segments of each vane portion, i.e., the slot therebetween. Moreover, it is believed further advantageous to apportion functions to vane segments, namely, handle aerodynamic load via the leading, i.e., curved, vane portion, and handle structural load via the trailing, i.e., straight, vane segment. Further still, it is believed that reduced fan drag at off-design incidence angles (fan operating points) and reduced drag in fans with reversible impellers operating in reverse direction are attained/attainable.

Thus, a guide vane for improved bidirectional flow conditioning is provided, and more particularly, a guide vane which permits improved primary flow via primary flow conditioning and which, without resort to mechanical complexity or structural changes via adjustment or the like, nonetheless provides meaningful secondary (i.e., reversible) flow. Advantageously, but hardly exclusively, the subject guide vane and/or fan assembly so characterized has particular utility in or for, among other applications, transit tunnel ventilation, mine ventilation, and "wind" simulators, e.g., tunnels, or the like.

More specific features and advantages obtained in view of those features will become apparent with reference to the drawing figures and DETAILED DESCRIPTION OF THE INVENTION.

DETAILED DESCRIPTION OF THE INVENTION

Non-limiting particulars are generally set forth in the figures and the following written description. More particularly, a fan assembly characterized by, among other things, guide vanes comprised of first and second guide vane segments, including exemplary particulars thereof/therefore, are set forth in connection to FIGS. 1-5. Test apparatus particulars are likewise provided (FIGS. 6-9), as are test apparatus performance graphics (FIGS. 10-15). While the following description proceeds with general reference to the figures, the depicted structures thereof and the relatedness or interrelatedness of same, it is to be understood that the description is intended as illustrative and non-limiting. Departures in and for the disclosed guide vane structures per se, their number, their relationship and/or arrangement relative to other fan assembly elements are subject to/of a given air handling application, i.e., objectives thereof.

Figure 1:
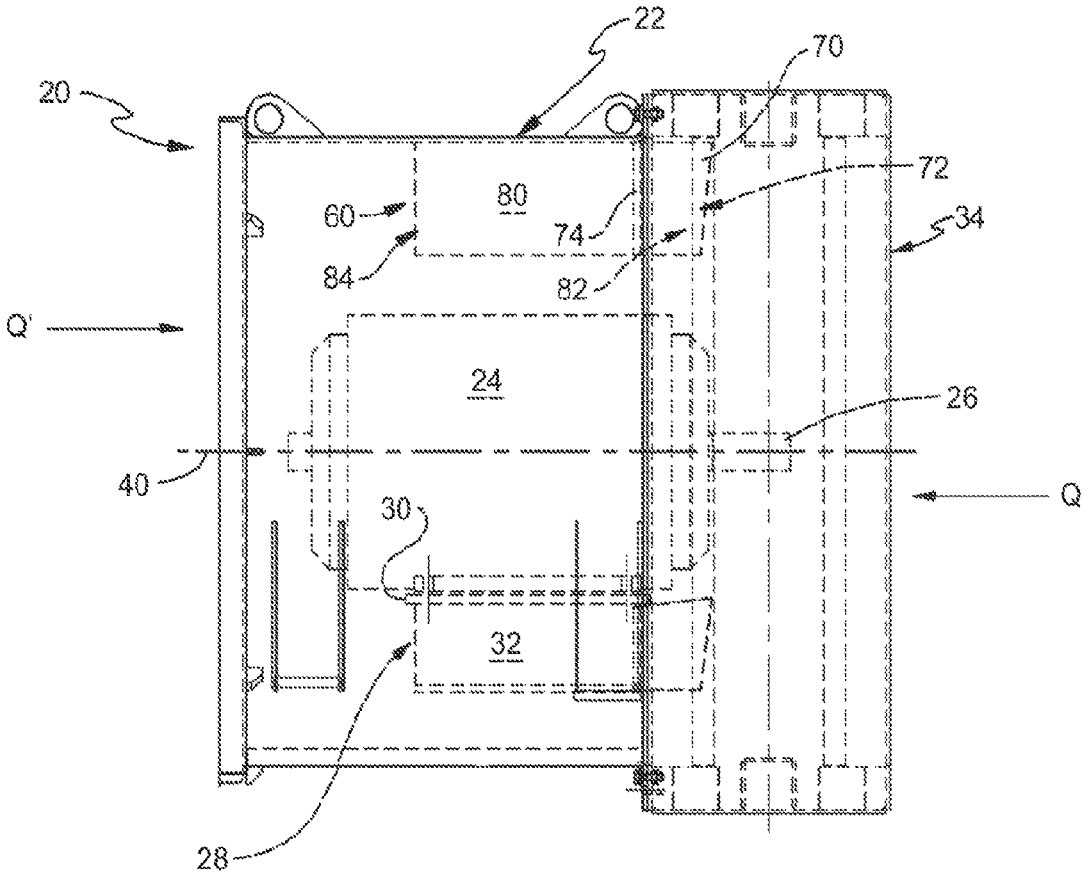
FIG. 1 depicts, in side elevation, a representative, non-limiting fan assembly characterized by, among other things, guide vanes comprised of first and second guide vane segments.
Figure 2:
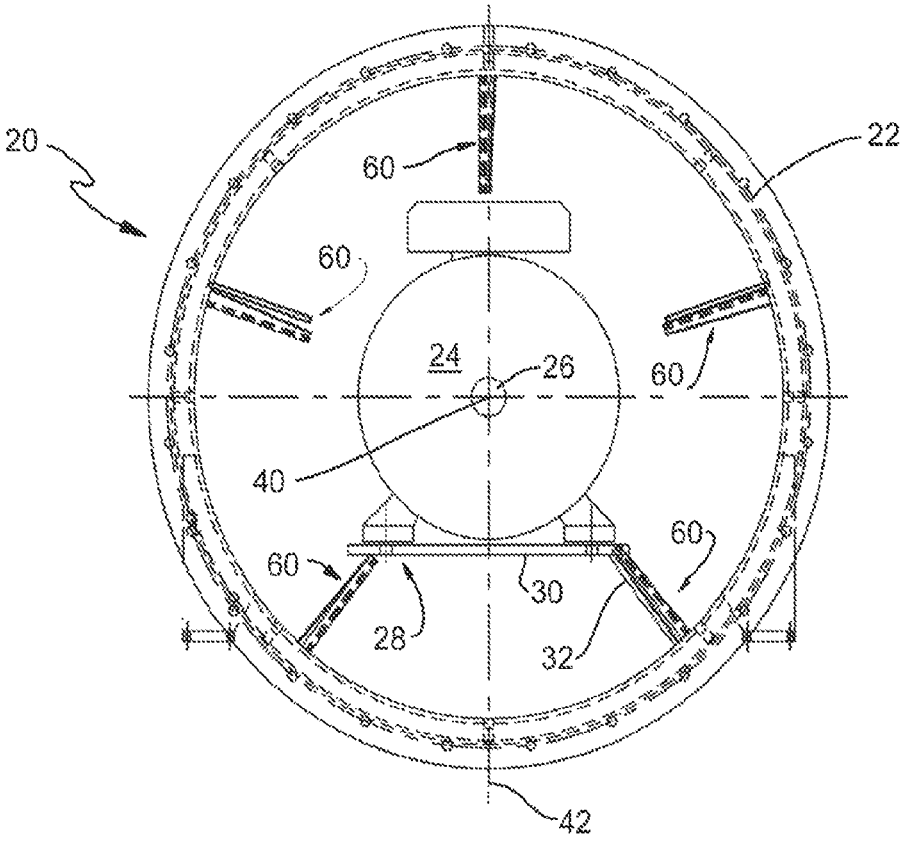
FIG. 2 depicts, in an end "front" elevation view, the assembly of FIG. 1.
Figure 3:
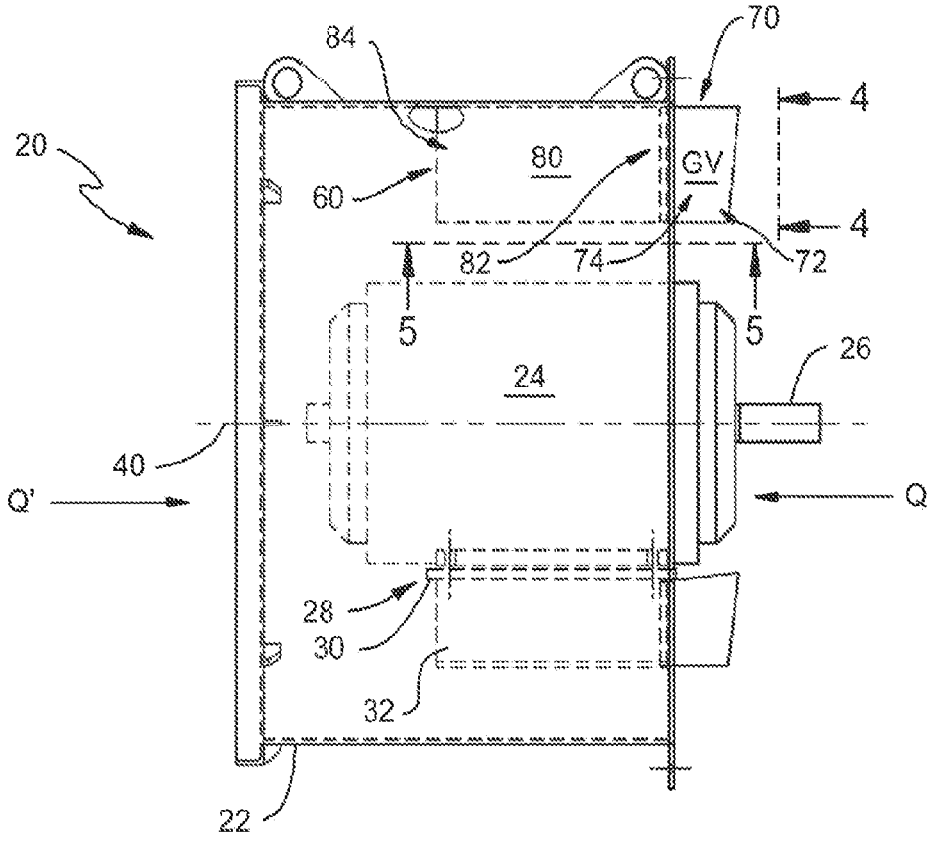
FIG. 3 depicts, in side elevation, an altered FIG. 1 assembly.

With initial reference to FIGS. 1-3, there is generally shown a fan assembly, e.g., an inline fan assembly 20, characterized by a fan casing or housing 22 within which an operative combination of an impeller (not shown) and a motor 24 reside. The impeller is conventionally supported upon shaft 26 of motor 24 so as to permit fluid flow in a first or "forward" axial flow direction Q (e.g., a primary flow direction), right to left as indicated FIGS. 1 & 3, and in a second or "reverse" axial flow direction Q' (e.g., a secondary flow direction) as indicated FIGS. 1 & 3. A motor support, e.g., base 28, fixedly positions motor 24 within casing 22 (FIG. 2), with base 28 generally characterized by a motor platform 30 and support legs or members 32 extending therefrom. An anti-stall device 34, intended to generally circumscribe the impeller so as to alter the airflow patterns around the impeller blades and thus allow stable fan operation over the entire range of airflow and pressure, is depicted in the assembly of FIG. 1, and omitted in the depiction of FIG. 3.

Figure 4:
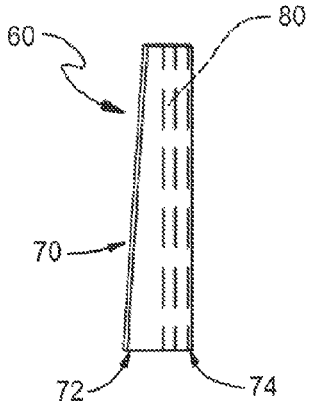
FIG. 4 depicts, in end view, a guide vane of the FIG. 3 assembly, more particularly, an end view as indicated via line 4-4 thereof.
Figure 5:
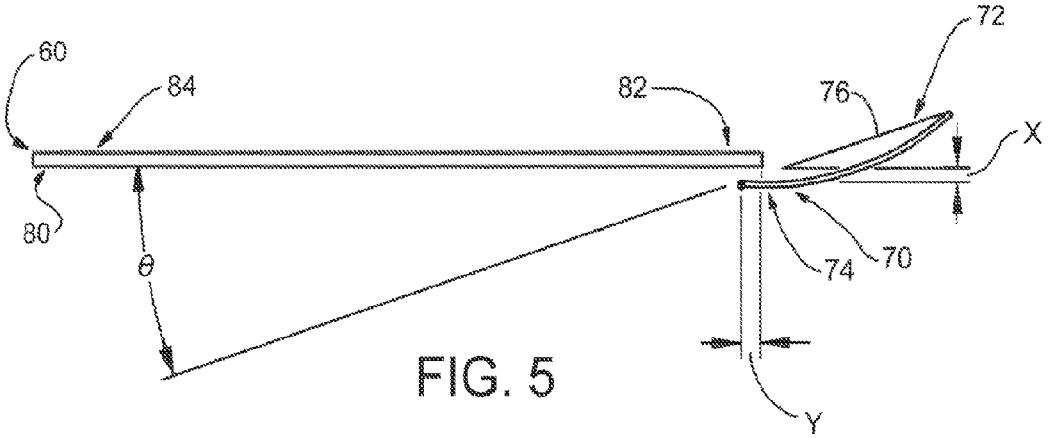
FIG. 5 depicts, in side view, the guide vane of the FIG. 3 assembly, more particularly, a side view as indicated via line 5-5 thereof.

With continued general reference to FIGS. 1-3, and particular reference to FIGS. 4 & 5, an improved guide vane 60 for an inline fan is shown. Guide vane 60 is generally characterized by first 70 and second 80 non-united guide vane segments (see especially FIG. 5). Each guide vane segment 70, 80 may be fairly characterized as having first and second end portions, more particularly, first vane segment 70 includes first end portion 72 and second end portion 74, whereas second vane segment 80 includes first end portion 82 and second end portion 84 (FIG. 5).

Advantageously, first guide vane segment 70 is non-linear, e.g., arcuate as is generally shown, with second guide vane segment being linear/substantially linear. As is appreciated with reference to FIG. 1 or 3, first guide vane segment 70 is adjacent to or proximal of the impeller (i.e., more particularly, first end portion 72 thereof), with the second guide vane segment 80 being distal of the impeller. In "forward" flow operation, the first guide segment 70 is a leading vane guide segment (i.e., more particularly, first end portion 72 thereof), while in "reverse" flow operation, second guide segment 80 is a leading vane guide segment (i.e., more particularly, second end portion 84 thereof).

With particular reference now to FIGS. 4 & 5, guide vane 60 is characterized by a gap, more particularly a slot 62. First vane segment 70 and second vane segment 80 are generally disposed, in relation to fan casing 22 or the like, in a spaced apart and overlapped arrangement. More particularly, second end portion 74 of first vane segment 70 is spaced apart a distance X and overlapped a distance Y in relation to first end portion 82 of second vane segment 80, with X & Y thusly delimiting slot 62.

Slot 62 may be of uniform width across its length, or may be characterized by a convergence of divergency in the direction of primary flow (i.e., the "leading" edge of the second vane segment, namely, a free end of the first end portion 82 thereof, may be at a relative max/min in relation to first vane segment, when compared to relationship of the "trailing" edge of the first vane segment, namely, a free end of the second end portion 74 thereof, in relation to the second vane segment). Moreover, the relationship for and between the spaced apart and overlapped conditions associated with the vane segments may be characterized a ratio of X to Y, with such ratios being less than, equal to, or greater than unity.

In addition to slot particulars X & Y, a vane pitch angle θ is likewise an application specific design parameter for specification or designation. As indicated with reference to FIG. 5, vane pitch angle θ is generally the angular relation between a line, e.g., cord 76, uniting free opposing ends of the first vane segment 70 and extending in the primary direction of fluid flow Q and the second vane segment 80. While single thickness guide vanes are generally shown and believed to be advantageous, i.e., each of the first and second vane segments 70, 80 comprise a single or uniform thickness construct, airfoil or other stylized sections may be suitably employed as circumstances warrant.

With regard to the first vane segment 70, advantageously the first end portion 72 thereof includes a periphery which slopes toward an axial centerline and in a primary flow direction Q (i.e., away from the impeller). Generally, and as is best appreciated with reference to guide vane GV of FIG. 3, the first vane segment 70 may be fairly characterized, in plan view, as having a trapezoidal (or trapezoidal-like) configuration or layout. The vane segment length, degree of curvature, and/or degree of planar irregularity (e.g., twisting) are likewise application specific design parameters.

With regard to the second vane segment 80, it is advantageously, but not necessarily exclusively, a planar element, configured as a rectangle (FIG. 3). As is best appreciated with reference to FIGS. 1 & 2, support legs 32 of motor support 28 suitable comprise second vane segments for improved guide vanes which are generally proximal most guide vanes in relation to a vertical centerline 42 (FIG. 2).

While it is to be appreciated that optimal relationships for, between and among guide vane segments, and attendant to either of the vane segments, are a part-and-parcel of application objectives and the like, such particulars resulting from a subsequently described wind tunnel application/application related test are worth noting. For example, and without limitation, the improved guide vane layout of FIG. 5 contemplates an overall dimension of about 19", with the linear vane segment having a length of 15" and a thickness of 0.25". Generally, but hardly necessarily, the length of the second vane segment represents greater than about one-half the length of the improved guide vane, and more particularly, represents greater than about two-thirds the length of the improved guide vane. A vane pitch angle of −17° is delimited via the indicated arrangement of the vane segments, with slot related criteria, namely, X and Y values, being 0.25" and 0.0375" respectively.

Having generally described an improved guide vane for an inline fan, attention is next directed to a working example and related test findings with regard to the heretofore described subject matter. Overall objectives were to improve fan efficiency in a forward flow direction while nonetheless maintaining an acceptable fan efficiency in a reverse flow direction. Reference is generally and primarily directed to the specifics of FIGS. 6-15.

Figure 6:
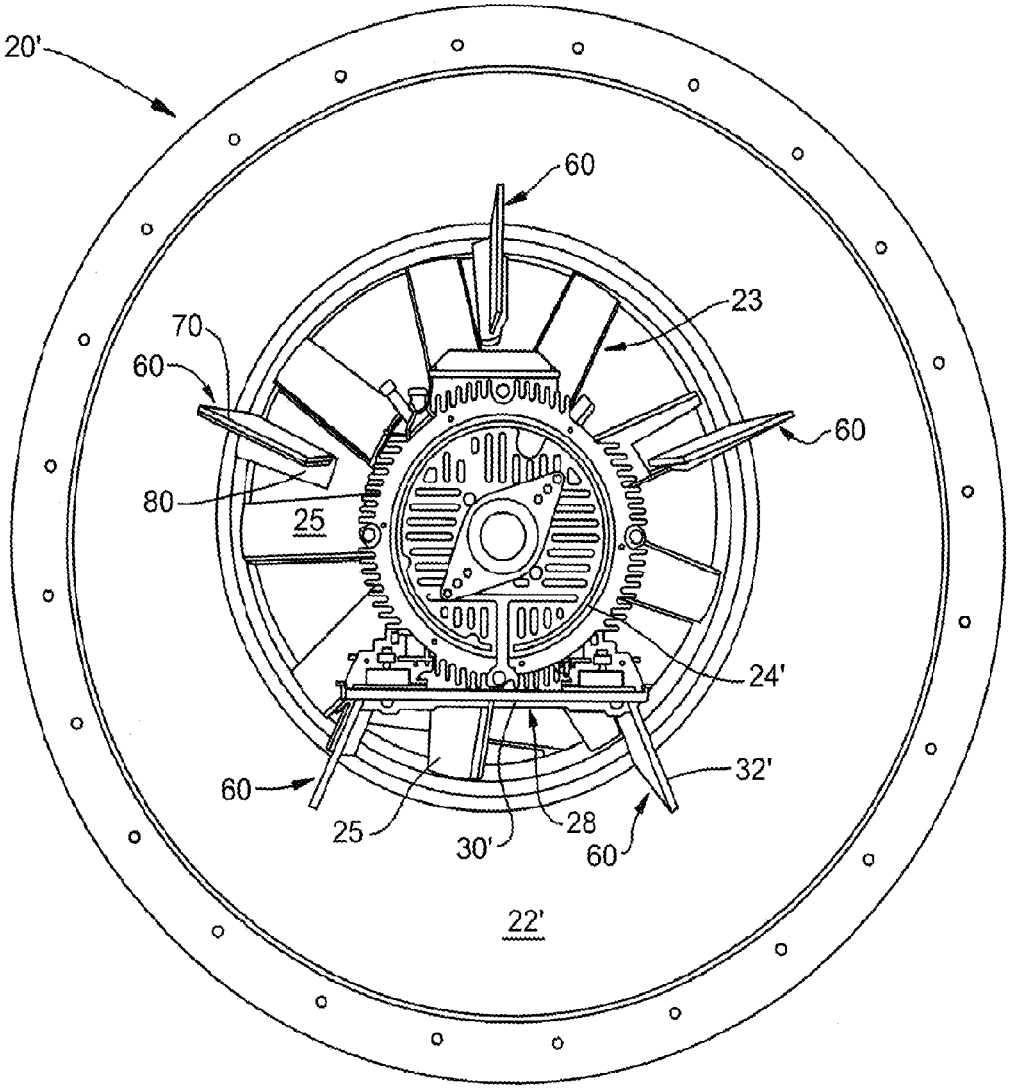
FIG. 6 depicts, in an end "rear" elevation view, a test fan assembly.

With general reference to FIG. 6 of FIGS. 6-9, provisions were made for a segmented, slotted guide vane, more particularly, an arrangement of such guide vanes, in the context of a 800 mm reversible axial fan with 0.4 hub ratio and approximately 43° blade angle. A test system or assembly is depicted in FIG. 6 wherein there is generally shown a fan assembly, e.g., an inline fan assembly 20', characterized by a fan casing or housing 22' within which an operative combination of an impeller 23 and a motor 24' reside. Impeller 23 is conventionally supported upon the shaft (not visible) of motor 24' so as to permit fluid flow in a first or "forward" axial flow direction via blades 25 thereof, toward the viewer in the as depicted end view, and in a second or "reverse" axial flow direction. A motor base 28' fixedly positions motor 24' within casing 22', with base 28' generally characterized by a motor platform 30' and support members 32' extending therefrom, the members functioning/operating as a second vane segment as previously described.

Figure 7:
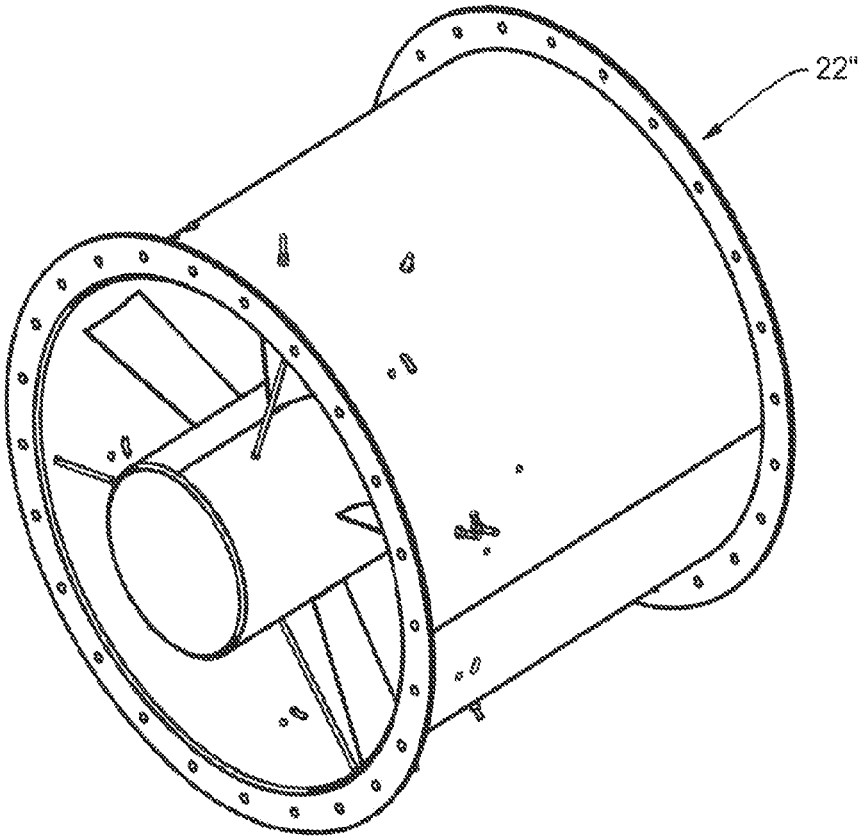
FIG. 7 depicts, in perspective view, a vane section of the assembly of FIG. 6.
Figure 9:
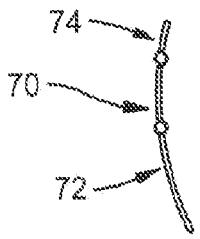
FIG. 9 depicts, in side/edge view, the curved guide vane segment of FIG. 8.
Figure 8:
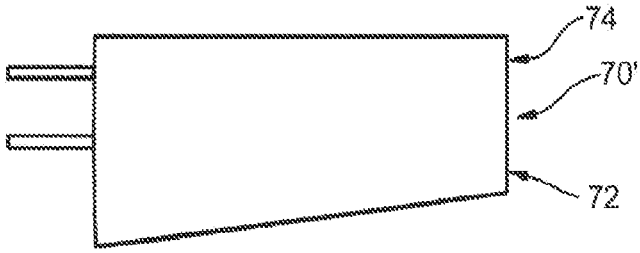
FIG. 8 depicts, in plan view, a concave surface of the curved segment of the guide vane of the test assembly of FIG. 6.
Figure 10:
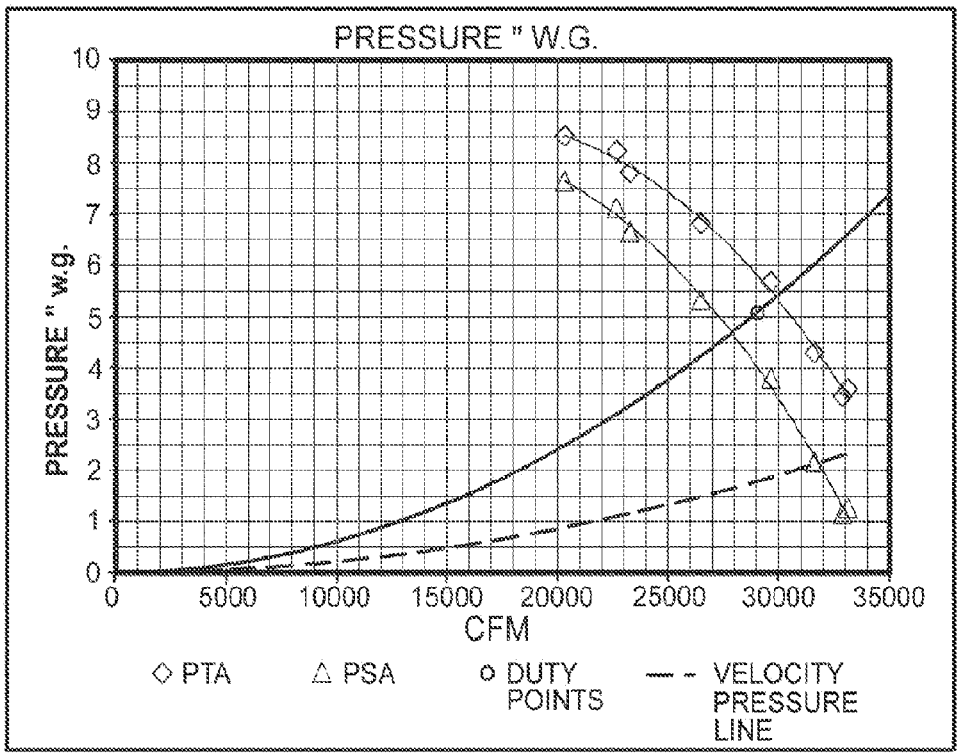
FIG. 10 depicts pressure versus flow relationships for "forward" or primary operation of the assembly of FIG. 6.
Figure 11:
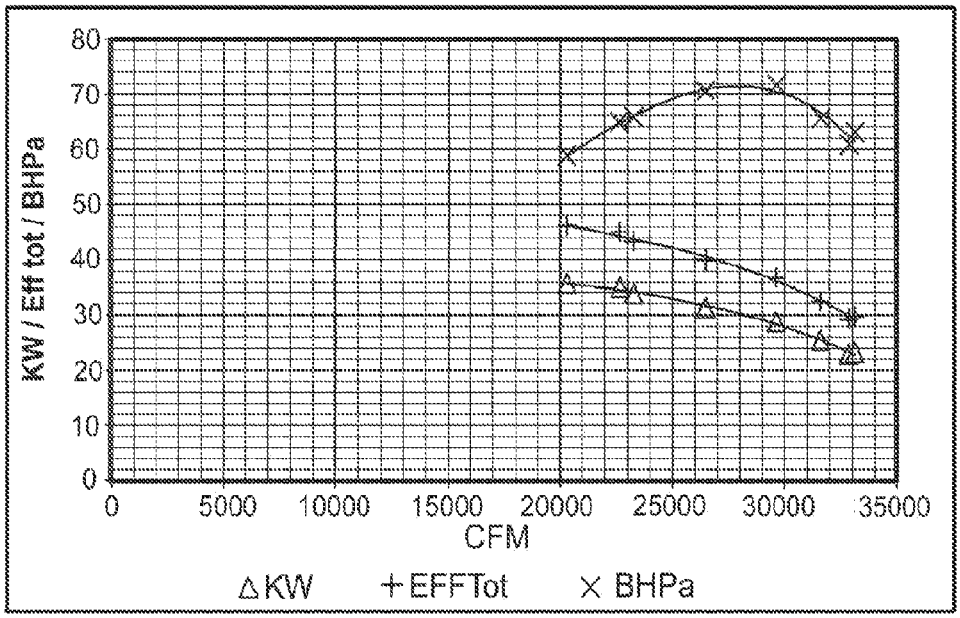
FIG. 11 depicts work/efficiency/brake horsepower versus flow relationships for "forward" or primary operation of the assembly of FIG. 6.

With reference now to FIGS. 7-9, a "bolt-on" vane section prototype 22" (FIG. 7), i.e., an adapted fan casing or housing, was utilized, more particularly, a single-thickness partially-reversible adjustable guide vane section was designed using truncated Twin City Fan (MN, USA) TCVA vanes (FIGS. 8 & 9). A prototype unit was constructed for vane angle optimization with an anti-stall section temporarily replaced with a straight section. Vane pitch angle was measured with a digital protractor with the mid-plane of each vane and optimized as −17° in a series of AMCA 210 air performance tests. Smooth airflow incident onto the vane leading edge was verified via string test at the forward design point. Performance targets included a forward efficiency of ≤69%, with forward and reverse operating parameters of 13.67 $m^3$/sec @ 1270 Pa TP @ 25° C., and 10.88 $m^3$/sec @ 610 Pa TP @ 25° C., respectively. The subject test fan assembly was selectively driven with a 30 kW 3600 rpm 575V motor.

Figure 12:
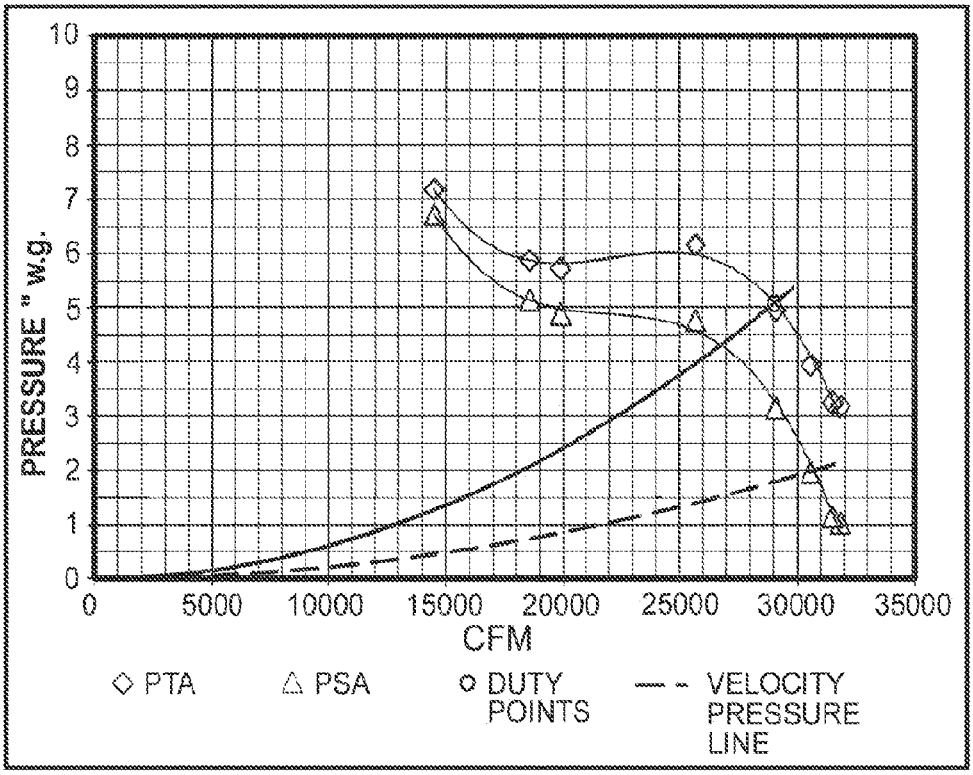
FIG. 12 depicts pressure versus flow relationships for "reverse" or secondary operation of the assembly of FIG. 6.
Figure 13:
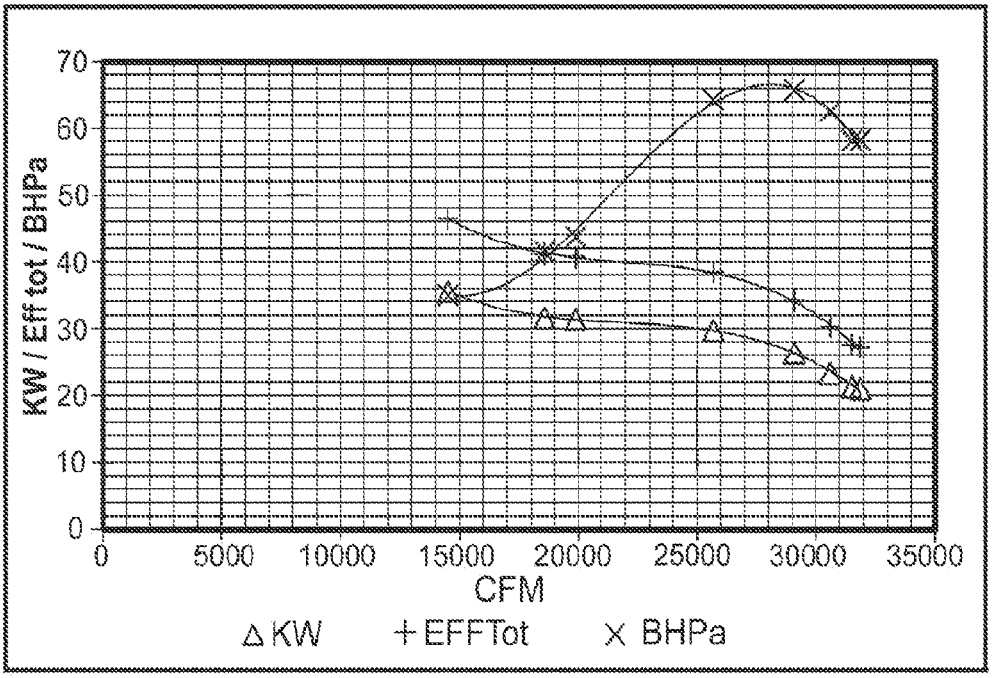
FIG. 13 depicts work/efficiency/brake horsepower versus flow relationships for "reverse" or secondary operation of the assembly of FIG. 6.

For each of the components of the bidirectional test, eight data points were taken. Data representations are provided with reference to FIGS. 10-13, more particularly, graphs of pressure versus flow and combined work-efficiency-break horse power versus flow for forward air flow (FIGS. 10 & 11 respectively) and reverse airflow (FIGS. 12 & 13 respectively). Resultant forward and reverse performance graphs are noted (FIGS. 13 & 14), namely total pressure versus flow and combined efficiency-brake horse power versus flow.

Figure 14:
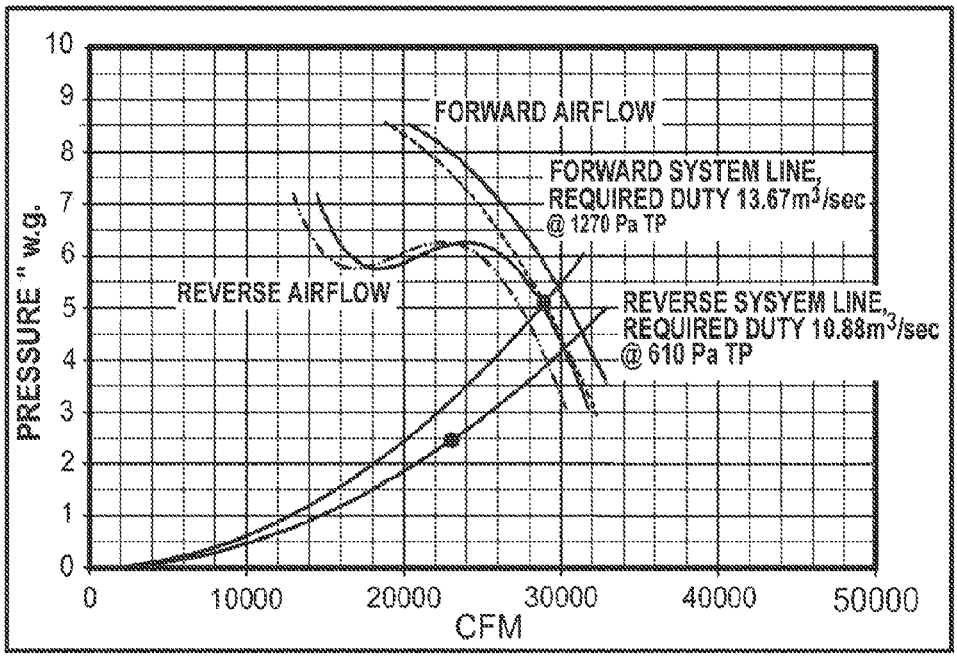
FIG. 14 depicts resultant pressure versus flow relationships.
Figure 15:
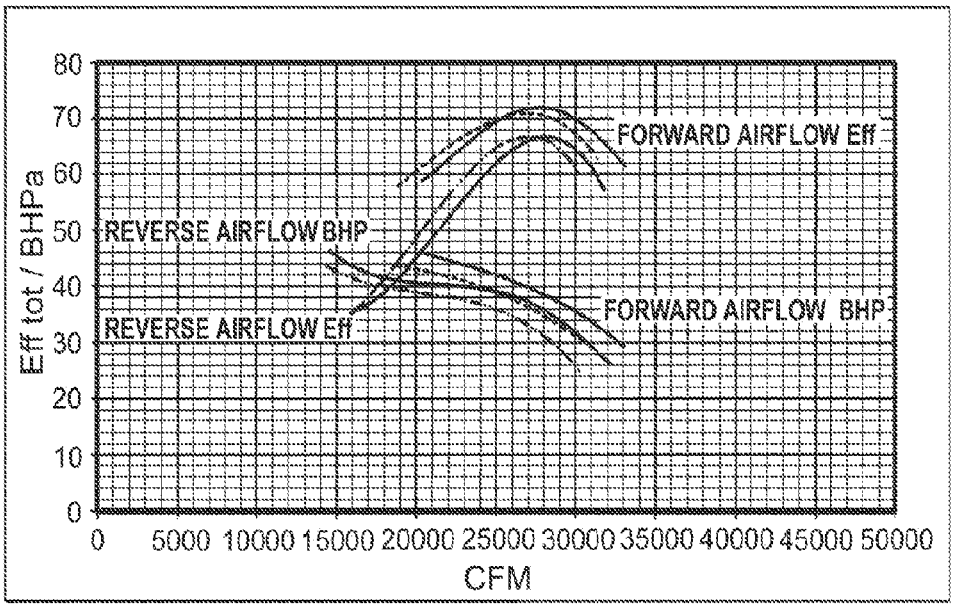
FIG. 15 depicts resultant work/efficiency/brake horsepower versus flow relationships.

As to test findings, optimal guide vane design is a truncated TCVA, with a pitch angle of −17°. The completed and tested prototype unit with a curved vane segment set at −17° and the impeller blade angle set at 43° provide 29,800 4.06 $m^3$/sec @ 5.4"w.g. TP/1345 Pa TP and absorbing 35.8 BHPa or 26.7 kW while running in forward. The unit likewise provided 30,200 CFM/14.25 $m^3$/sec @ 4.2"w.g. TP/1046 Pa TP and absorbing 31.9 BHPa or 23.8 kW while running in reverse. With a revised blade angle setting for the impeller from 43° to 42°, the dashed lines with regard to FIGS. 14 & 15 provide projected performance characteristics, namely, 28,900 CFM/13.6 $m^3$/sec @ 5.09"w.g. TP/1267 Pa TP and absorbing 33.2 BHPa or 24.7 kW while running in forward. The unit will provide 29,200 CFM/13.8 $m^3$/sec @ 3.9"w.g. TP/971 Pa TP and absorbing 28.2 BHPa or 21 kW while running in reverse. The efficiency of the unit while operating in forward flow will be 69.54% and 63.8% while operating in reverse flow.

Finally, since the assemblies, subassemblies, devices, structures and/or elements disclosed directly or implicitly herein may be embodied in other specific forms without departing from the spirit or general characteristics thereof, some of which forms have been indicated, the features described and depicted herein/herewith are to be considered in all respects illustrative and not restrictive. Accordingly, the scope of the subject invention is as defined in the language of the appended claims, and includes not insubstantial equivalents thereto.

The invention claimed is:

1. A guide vane for a fan comprising a first vane segment characterized by first and second end portions and a second vane segment characterized by first and second end portions, said second end portion of said first vane segment being in a spaced apart and overlapped arrangement in relation to said first end portion of said second vane segment, said first end portion of said first vane segment being an adjacent most vane guide end portion in relation to an impeller of the fan, said first vane segment being of arcuate configuration, said second vane segment being of linear configuration.

2. The guide vane of claim 1 wherein said first vane segment comprises a single thickness element.

3. The guide vane of claim 1 wherein said second vane segment comprises a single thickness element.

4. The guide vane of claim 1 wherein said first and said second vane segments each comprise a single thickness element.

5. The guide vane of claim 1 wherein said first vane segment comprises an airfoil.

6. The guide vane of claim 1 wherein said second vane segment is adapted to support a motor of the fan.

7. The guide vane of claim 1 wherein said first vane segment is characterized by a trapezoidal configuration in plan view.

8. The guide vane of claim 1 wherein said first end portion of said first vane segment includes a peripheral portion which angles away from an impeller and toward an axial centerline of the fan.

9. The guide vane of claim 1 wherein a spacing for said spaced apart condition for said second end portion of said first vane segment in relation to said first end portion of said second vane segment is uniform.

10. The guide vane of claim 1 wherein a spacing for said spaced apart condition for said second end portion of said first vane segment in relation to said first end portion of said second vane segment is converging relative to an impeller of the fan.

11. The guide vane of claim 1 wherein a spacing for said spaced apart condition for said second end portion of said first vane segment in relation to said first end portion of said second vane segment is diverging relative to an impeller of the fan.

12. The guide vane of claim 1 wherein said spaced apart condition and said overlapped arrangement for/between said second end portion of said first vane segment in relation to said first end portion of said second vane segment are characterized by dimensions X and Y respectively, a ratio of X to Y being greater than one.

13. The guide vane of claim 1 wherein said spaced apart condition and said overlapped arrangement for/between said second end portion of said first vane segment in relation to said first end portion of said second vane segment are characterized by dimensions X and Y respectively, a ratio of X to Y being less than one.

14. The guide vane of claim 1 wherein said spaced apart condition and said overlapped arrangement for/between said second end portion of said first vane segment in relation to said first end portion of said second vane segment are characterized by dimensions X and Y respectively, a ratio of X to Y being about one.

15. The guide vane of claim 1 wherein a length of said second vane segment represents greater than one-half of a length of the guide vane.

16. The guide vane of claim 1 wherein a length of said second vane segment represents greater than two-thirds of a length of the guide vane.

17. An inline fan assembly comprising:

a. a fan casing;

b. a motor;

c. a motor base for supporting said motor in a spaced apart condition relative to a circumferential wall of said fan casing;

c. an impeller operatively supported by said motor for select bidirectional rotation in furtherance of establishing either of a primary fluid flow or a secondary fluid flow; and, d. a plurality of uniformly spaced guide vanes, each guide vane of said plurality of guide vanes radially extending from said circumferential wall and axially extending along a segment of said fan casing corresponding to said motor, each guide vane of said plurality of vane guides characterized by a first guide vane segment and a second vane guide segment, said first vane segment being in a spaced apart and partially overlapped arrangement in relation to said second vane segment, said first vane segment upstream of said second vane segment during primary fluid flow.

* * * * *